US005363993A

United States Patent [19]

Mascitelli et al.

[11] Patent Number: 5,363,993

[45] Date of Patent: Nov. 15, 1994

[54] PLASTIC DISPENSER FOR LIQUIDS OR OTHER SUBSTANCES

[75] Inventors: Francesco Mascitelli, Pescara; Enrico Bonelli, Casalincontrada; Berardinucci Donato, Pescara, all of Italy

[73] Assignee: SAR S.p.A., Italy

[21] Appl. No.: 990,411

[22] Filed: Dec. 15, 1992

[30] Foreign Application Priority Data

Dec. 16, 1991 [IT] Italy ..... MI91 A 003357

[51] Int. Cl.[5] ..... B67D 5/42

[52] U.S. Cl. ..... 222/321; 222/385

[58] Field of Search ..... 222/207, 209, 321, 383, 222/385

[56] References Cited

U.S. PATENT DOCUMENTS

| | | | |
|---|---|---|---|
| 3,187,960 | 6/1965 | Gorman | 222/383 X |
| 3,785,532 | 1/1974 | Cooprider | 222/383 X |
| 4,201,317 | 5/1980 | Aleff | 222/383 X |
| 4,225,061 | 9/1980 | Blake et al. | 222/383 X |
| 4,762,475 | 8/1988 | Fuchs | 222/383 X |

FOREIGN PATENT DOCUMENTS

| | | | |
|---|---|---|---|
| 0199143 | 10/1986 | European Pat. Off. . | |
| 0253495 | 1/1988 | European Pat. Off. . | |
| 0505900 | 9/1992 | European Pat. Off. . | |
| 2643338 | 8/1990 | France | 222/321 |
| 21196A | 8/1990 | Italy . | |
| 9103321 | 3/1991 | WIPO . | |

*Primary Examiner*—Andres Kashnikow
*Assistant Examiner*—Kenneth Bomberg
*Attorney, Agent, or Firm*—Steinberg, Raskin & Davidson

[57] ABSTRACT

A dispenser (10) for dispensing, liquid substances or substances in the form of cream or paste, comprising a pump (1) in which in addition to the non-return valve (17), the elastic structure for returning the piston (3) into its rest position following the operation of the dispensing knob (10) are also of plastics material, and consist of a skirt (4A) which deforms elastically when the knob (10) is pressed. To make the dispenser (10) completely salvageable, all its constituent elements are of one and the same plastics material, which is of a type from which both substantially rigid pieces and substantially elastically deformable pieces can be formed. Such a plastics material is for example polyethylene.

17 Claims, 1 Drawing Sheet

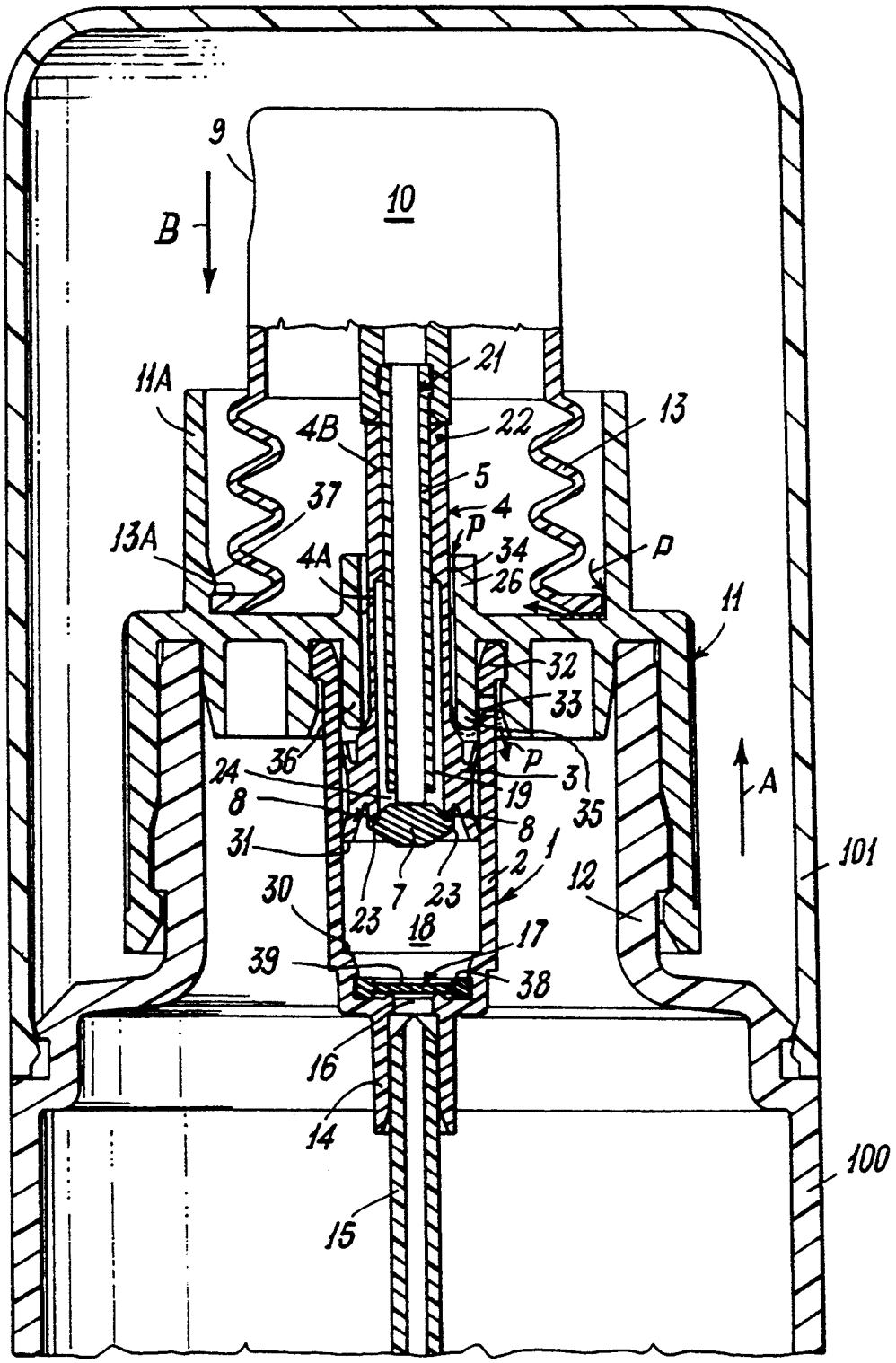
9
10
B
21
11A
22
13
4B
5
37
4
P
13A
4A
34
P
26
11
32
33
36
P
3
24
19
35
A
8
8
31
1
2
101
12
30
7
23
23
18
17
39
38
16
14
100
15

PLASTIC DISPENSER FOR LIQUIDS OR OTHER SUBSTANCES

BACKGROUND OF THE INVENTION

This invention relates to a dispenser for dispensing liquid substances or substances in the form of cream or paste, the dispenser comprising a bottle for containing said substance to be dispensed, a pump operable manually to dispense a predetermined Quantity of substance, and a socket ring for fixing the pump to the bottle mouth.

Dispensers of this type have been known for some time. The pumps used in such dispensers consist substantially of: an overall cylindrical body open at its two ends, at a first end there being provided a non-return valve: an overall cylindrical hollow shaft coaxial to the hollow body and partly enclosed in it, one end of said shaft projecting to the outside through the second end of the hollow body, the shaft being movable axially in both directions relative to the hollow body,the projecting end of the shaft carrying a dispensing knob provided with a dispensing nozzle which communicates with the interior of the shaft, the other end of the shaft comprising at least one aperture for communication between the interior of the shaft and the interior of the hollow body: a piston movable in both directions under fluid-tight conditions within the hollow body, that internal part of the hollow body situated between the piston and said non-return valve defining a pressure chamber, the piston being mounted on said shaft and being movable in both directions under fluid-tight conditions relative to the shaft to open or close said apertures in the shaft; a first helical metal return spring for returning the piston to its rest position in which the apertures in the shaft are closed when no pressure is exerted on the dispensing knob; a second helical metal return spring for returning the shaft into the position in which it most projects from the hollow body when pressure on the dispensing knob ceases; an annular closure element for the second end of the hollow body, this closure element also acting as a guide for the shaft; and connection means, provided within the pump, for connecting the bottle interior to the outside, this connection being precluded when the piston is in its rest position.

The non-return valve is normally of the metal ball type and prevents the substance to be dispensed present in the pressure chamber from returning to the bottle.

A first drawback of these known dispensers is the fact that the relative pumps contain metal parts (in particular said non-return ball valve and the first return spring) which come into contact with the substance to be dispensed, with which they could react chemically, contaminating it. As a consequence, there is also corrosion of said metal parts, which can prejudice the proper operation of the pump.

Pumps are also known in which the metal ball non-return valve is replaced by a plastics valve of particular form (see for example patent application EP-A-0469368. Specifically, these valves can be constructed of a plastics material which is not attacked by the substance contained in the bottle. This however is not sufficient to completely overcome the problem of contamination.

OBJECTS AND SUMMARY OF THE INVENTION

The first object of the present invention is therefore to provide a dispenser of the stated type which does not allow contamination of the dispensed substance.

With reference to the problem of salvaging and recycling the constituent materials of the dispenser once empty, it is apparent that the presence of metal parts in the pump creates serious problems from this viewpoint. This is because the pump has to be removed and thrown away. Such an operation seriously affects salvaging costs to the extent of making it impracticable. Again, even if a pump were to be constructed without metal parts, the problem would still not be solved. In this respect, as is well known to the expert of the art, in addition to metal parts known pumps also comprise various types of plastics material. This is because certain parts of the pump have to be of substantially rigid material whereas other parts have to be of substantially deformable material. Hence one and the same pump can comprise some parts of acetal resin and other parts of polypropylene, polyethylene or other plastics. Again, these plastics can be different from that used to form the bottle and/or the socket ring for fixing the pump to the bottle.

Consequently even under these circumstances it still becomes necessary to remove the pump, which still has to be thrown away as it is impracticable to salvage its individual plastics materials by dismantling the pump.

Hence the salvaging and recycling of the constituent materials of a dispenser of known type is not convenient in practice.

On the basis of the aforegoing the second object of the present invention is to provide a dispenser such that not only can its constituent materials be salvaged but that such salvaging is also convenient, The third object of the present invention is to provide a dispenser in which the pump is extremely simple and is easy to assemble, the dispenser hence being of very low cost.

The first stated object is attained by the dispenser of the present invention, characterised in that said first elastic return means consist of a coaxial skirt of elastically deformable plastics material, this skirt being deformable when pressing the dispensing knob, Hences said skirt operates as the piston return spring, enabling the piston to return to its rest position, The skirt can also be in the form of an axially deformable bellows, From the aforegoing it will be apparent that the dispenser according to the present invention no longer comprises any metal part in contact with the substance dispensed. The problem of substance contamination is therefore solved.

Starting with a dispenser of the described type the problem connected with the aforesaid second object of the invention, ie to provide a dispenser of which the constituent materials can be easily and economically salvaged can also be solved.

This object is attained in that in the dispenser according to the invention the aforesaid second elastic means are of elastically deformable plastics material, the bottle, the socket ring for fixing the pump, all the pump constituent parts and any additional parts all being formed from the same plastics material, which is of a type which enables both substantially rigid pieces and substantially elastically deformable pieces to be formed.

As will be apparent, when the last dose of substance contained in the bottle has been dispensed such a dispenser can be totally salvaged as it consists completely of the same type of plastics material.

A plastics material having the said characteristics is for example polyethylene, which is available in high density (HDPE), low density (LDPE) and very low density (LLDPE) form. As is well known, high density polyethylene is substantially rigid whereas low density polyethylene is substantially elastically deformable, and very low density polyethylene is even more deformable.

The dispenser according to the present invention also attains the stated third object of the invention. In this respect by replacing all the pump metal parts with plastics parts and making all the pump parts of the same type of plastics material, not only can these parts be formed by injection moulding but in addition the number of component parts can be reduced to a very small number, so considerably facilitating pump assembly. The dispenser can consequently be of low cost.

BRIEF DESCRIPTION OF THE DRAWING

The invention will be more apparent from the ensuing description of one embodiment thereof. In the description reference is made to the accompanying drawing, which represents a partial vertical axial section through a dispenser according to the invention.

DETAILED DESCRIPTION OF THE INVENTION

The dispenser shown on the drawing comprises a bottle 100 to contain the substance to be dispensed, a manual pump 1 for dispensing a predetermined quantity of substance, and a socket ring 11 for fixing the pump to the neck 12 of the bottle 100. The pump comprises a cylindrical hollow body 2, within the cavity of which the piston 3 of an overall cylindrical hollow piston unit 4 slides and in which a cylindrical hollow shaft 5 is inserted. At its lower end (with respect to the figure) said shaft comprises, integral therewith, a valving member 7 which in cooperation with a lower annular lip 8 of said piston unit 4 forms a valve for providing or excluding communication between the interior of the cylindrical body 2 and the interior of the shaft 5. The upper ends of the shaft 5 and piston unit 4 are coaxial and rigid with each other by the fact of forcing one end (of the shaft 5) into the other end (of the piston unit 4) and are associated with a dispensing knob 10 of usual type, provided with a dispensing nozzle 9 (visible in profile in the figure). The dispenser also comprises a socket ring 11 with various functions, namely to act as a closure element for the upper aperture of the cylindrical body 2, to limit the stroke of the piston of the piston unit 4 by means of the inner annular protuberance 36 which also acts as a guide for the shaft 5, and to fix the pump 1 to the neck 12 of the bottle 100.

The dispensing, knob 10 is formed with its lower part 13 in the shape of a bellows 13. The lower edge 13A of this bellows is thickened and arranged to snap-engage the socket ring 11, as shown in the figure. More specifically, the socket ring 11 comprises an upwardly extending annular projection 11A which on its inner surface comprises a series of protuberances 37 used to lock the thickened lower edge 13A of the bellows 13 in position. The annular projection 11A also serves as protection for the bellows 13.

The piston 3 of the piston unit 4, the valving member 7 and the lower part of the cylindrical body 2 define a pressure chamber 18. This latter lowerly comprises, opposite the piston 3 and the valving member 7, an aperture 16 opening into a spout 14 in which a tube 15 is inserted to dip into the bottle 100 containing the substance to be dispensed.

At the aperture 16 there is provided a non-return valve 17 which enables the substance to be dispensed to enter the chamber 18 but not to leave it. The valve 17, comprising an annular rim 38, is housed in a seat provided in the cylindrical body 2. A circular wall 39 is connected in one piece to a portion of said annular rim 38 so as to rest on the rim of the aperture 16 and close it, but to be able to flex towards the interior of the chamber 18 by the action of the substance drawn through the tube 15, to enable the substance to be dispensed to enter the chamber.

In proximity to its lower end the cylindrical body 2 also comprises an annular step 30 on which the lower edge 31 of the piston 3 of the piston unit 4 rests during the priming of the pump. In the wall of the cylindrical body 2 in proximity to its upper edge 32 there is provided an aperture 33 the purpose of which is clarified hereinafter.

In addition to the piston 3, the piston unit 4 comprises a hollow cylindrical shank consisting of two parts, namely a lower part 4A or skirt close to the piston 3 and of lesser cylindrical wall thickness, and an upper part 4B of greater cylindrical wall thickness. As stated, the upper part 4B is forced onto the shaft 5 and is rigid therewith. As can be seen in the figure, the skirt 4A is spaced both from the shaft 5 (to form an interspace 19) and from the inner surface of the combined inner annular protuberance 36 and outer annular protuberance 26.

The piston 3 of the piston unit 4 is slidable within the cylindrical body 2 and is of the conventional form to ensure a perfect seal against the fluid contained in the chamber 18. As can be seen from the figure, the upper end 21 of the hollow shaft 5 is snap-fitted in known manner to a dispensing knob 10. The valving member 7 at the lower end of the shaft 5 comprises a step 23 on which an annular lip 8 of the piston 3 rests when the pump is in its rest position, to hence form a seal which prevents the substance contained in the chamber 18 from penetrating into the interspace 19 and into the shaft 5 through the apertures 24 provided in its lower end. As can be seen from the figure, the valving member 7 is fixed to the shaft 5 so as to form opposing apertures 24 for connecting the pressure chamber 18 to the interior of the shaft 5.

As stated, an interspace 34 remains between the inner surface of the combined annular protuberances 26 and 36 and the surface of the parts 4A, 4B of the piston unit 4.

In addition besides forming a seal, the lower edge 35 of the inner annular protuberance 36 acts as a travel stop for the piston 3 during its upward travel (ie in the direction of the arrow A) when the knob is released.

The dispenser according to the invention also comprises a usual protection cap 101 for the pump 1, to be snap-connected to the bottle as shown in the figure.

All the described pump components are formed of the same type of plastics material by injection moulding. More specifically, the dispensing knob 10, the bellows 13, the piston unit 4 comprising the piston 3, the non-return valve 17 and the dip tube 15 are all constructed of low density polyethylene, whereas the remaining components, including the bottle 100 and cap 101, are formed of high density polyethylene. The bottle is conveniently formed by blow-moulding.

The pump according to the invention operates in the following manner.

The priming stage of the pump 1 will firstly be examined. On pressing the dispensing knob 10 downwards (in the direction of the arrow B). the piston unit 4 and the shaft 5 are also dragged downwards to hence compress the air contained in the chamber 18, which is lowerly closed by the non-return valve 17. At the end of its travel, the lower edge 31 of the piston 3 abuts against the step 30 provided on the cylindrical body 2. On continuing to press the dispensing knob 10, the skirt 4A of the piston unit 4 deforms barrel-like outwards. This separates the annular lid 2 of the piston 3 from the step 23 on the valving member 7. A passage is therefore opened between the chamber 18 and the interior of the shaft 5 (via the two apertures 24) to enable the air, compressed within the chamber 18, to emerge through the nozzle 9 of the dispensing knob 10. At this point the dispensing knob 10 is released and is returned to its initial position by the elastic bellows 13, also dragging the piston unit 4 with the piston 3, the shaft 5 and the valving member 7. Consequently when the deformation of the skirt 4A ceases, the lip 8 again closes onto the step 23 of the valving member 7, to hence close the communication between the chamber 18 and the interior of the shaft 5. This creates in the chamber 18, a vacuum which causes the non-return valve 17 to open and the chamber 18 to be filled with the predetermined quantity of substance to be dispensed. The pump is hence ready for use.

The channel formed by said interspace 34 and aperture 33., the path of which is indicated in the figure by the arrows P, enables a volume of air to enter the bottle 100 in known manner equal to the volume of substance which is dispensed each time by the action of the pump 1.

We claim:

1. A dispenser for dispensing liquid substances or substances in the form of cream or paste including a plurality of components, comprising a bottle for containing the substance to be dispensed and having an interior and a mouth, a manual pump for dispensing a predetermined quantity of substance, and a socket ring for fixing the pump to the bottle mouth, the pump comprising:

a substantially cylindrical hollow body having first and second open ends, said body having an interior, a flexible non-return valve arranged at said first end, a substantially cylindrical hollow shaft having an interior, said shaft situated substantially coaxial to the hollow body and partly enclosed within said bottle interior, one end of said shaft projecting out of said bottle interior through the second end of the hollow body, the shaft being movable axially in both directions relative to the hollow body, the projecting end of the shaft carrying a plastics dispensing knob provided with a dispensing nozzle which communicates with the interior of the shaft, the other end of the shaft comprising at least one aperture for communication between the interior of the shaft and the interior of the hollow body, a piston unit comprising a piston movable in both directions under fluid-tight conditions within the hollow body, a portion of the interior of the hollow body situated between the piston and the non-return valve defining a pressure chamber, the piston being mounted on the shaft and being movable in both directions relative to the shaft to open or close said at least one aperture in the shaft;

first return means for returning the piston to a rest position in which said at least one aperture in the shaft is closed;

second return means for returning the shaft into the position in which it projects from the hollow body when pressure on the dispensing knob ceases;

an annular closure element for the second end of the hollow body, said closure element constituting a guide for the shaft; and connection means provided within the pump for connecting the interior of the bottle to the atmosphere, said connection means being interrupted when the piston is in its rest position;

said first return means including a shank comprising a skirt which deforms elastically when the dispensing knob is pressed, said second return means being made of an elastically deformable material, said second return means comprising an annular bellows element formed with the dispensing knob, all of said components of the dispenser being formed from a plastic material, which is of a type which enables both substantially rigid components and substantially elastic components to be formed.

2. The dispenser of claim 1, wherein all of said components are formed from the same plastic material.

3. A dispenser as claimed in claim 1, characterised in that said plastics material is polyethylene, which is available in high density, low density and very low density form.

4. A dispenser as claimed in claim 1, wherein said shank further comprises a first cylindrical part, said first cylindrical part of the shank of the piston unit being coaxially rigid with part of the shaft of the pump, said skirt having a cylindrical form and a smaller thickness than said first part, the skirt being formed integrally with the first cylindrical part and the piston.

5. A dispenser as claimed in claim 4, further comprising a valving member fixed to said other end of the shaft to cooperate with an annular lip on the piston to interrupt communication between the pressure chamber and the interior of the shaft, the valving member being connected to the shaft so as to form said at least one aperture which connects the pressure chamber to the interior of the shaft when the annular lip is not cooperating with the valving member.

6. A dispenser as claimed in claim 1, wherein said non-return valve comprises an annular rim, to at least one portion of which there is connected in one piece a circular wall which rests on the edge of an aperture present at the first end of the hollow body.

7. The dispenser of claim 1, wherein said bellows element has a thickened lower portion arranged to snap-engage with the socket ring.

8. The dispenser of claim 7, wherein the socket ring has protuberances on an inner surface thereof, said protuberances structured and arranged to lock said lower portion of said bellows element in a fixed position.

9. A dispenser for dispensing liquid substances or substances in the form of cream or paste including a plurality of components, comprising a bottle for containing the substance to be dispensed and having an interior and a mouth;

a manual pump for dispensing a predetermined quantity of substance; and a socket ring for fixing the pump to the bottle mouth;

the pump comprising a substantially cylindrical hollow body having first and second open ends, said body having an interior, a non-return valve arranged at said first end, a substantially cylindrical hollow shaft having an interior, said shaft situated substantially coaxial to the hollow body and partly enclosed within said bottle interior, said shaft having a first and second end, said first end of said shaft projecting to an outside of the dispenser through the second end of the hollow body, the shaft being axially movable relative to the hollow body, a dispensing knob having a dispensing nozzle which communicates with the interior of the shaft, said dispensing knob being connected to said first end of said shaft, said second end of said shaft having at least one aperture connecting the interior of the shaft to the interior of the hollow body, a piston unit comprising a piston and a shank comprising a skirt, said piston being movable under fluid-tight conditions within the hollow body, a pressure chamber being defined in the interior of the hollow body between the piston and the non-return valve, the piston being mounted on the shaft and being movable relative to the shaft to open or close said at least one aperture in the shaft;

first return means for returning the piston to a rest position in which the apertures in the shaft are closed, said first return means including the skirt of the piston unit which deforms elastically when the dispensing knob is pressed;

second return means for returning the shaft into a position in which it projects from the hollow body when pressure on the dispensing knob ceases, said second return means comprising an annular bellows element formed with the dispensing knob;

an annular closure element for the second end of the hollow body, said closure element constituting a guide for the shaft; and connection means arranged within said pump for connecting the interior of the bottle to the atmosphere, said connection means being closed when the piston is in its rest position.

10. The dispenser of claim 9, wherein said bellows element has a thickened lower portion arranged to snap-engage with the socket ring.

11. The dispenser of claim 10, wherein the socket ring has protuberances on an inner surface thereof, said protuberances structured and arranged to lock said lower portion of said bellows element in a fixed position.

12. The dispenser of claim 9, wherein said second return means is made of an elastically deformable material.

13. The dispenser of claim 9, wherein all of said components of the dispenser are formed of a plastic material, which is of a type which enables both substantially rigid components and substantially elastically deformable components to be formed.

14. The dispenser of claim 9, wherein all of said components are formed from the same plastic material.

15. The dispenser of claim 9, wherein said shank further comprises a first cylindrical part coaxially rigid with part of the shaft of the pump, said skirt having a cylindrical form and a smaller thickness than said first part, said skirt being formed integrally with the first cylindrical part and the piston.

16. The dispenser of claim 15, further comprising a valving member fixed to said second end of the shaft and cooperating with an annular lip on the piston in order to interrupt communication between the pressure chamber and the interior of the shaft, the valving member being connected to the shaft so as to form said at least one aperture which connects the pressure chamber to the interior of the shaft when the annular lip is not cooperating with the valving member.

17. The dispenser of claim 9, wherein said non-return valve comprises an annular rim, a circular wall connected to said annular rim, said circular wall arranged to rest on an edge of an aperture at the first end of the hollow body.

* * * * *